US005613783A

United States Patent [19]

Kinney et al.

[11] Patent Number: 5,613,783

[45] Date of Patent: Mar. 25, 1997

[54] POINT OF SALE PRINTER WITH MAGNETIC READER

[75] Inventors: Michael J. Kinney; Robert W. Kruppa; Robert A. Myers, all of Cary, N.C.

[73] Assignee: International Business Machines Corporation, Armonk, N.Y.

[21] Appl. No.: 411,106

[22] Filed: Mar. 27, 1995

[51] Int. Cl.[6] ..... B41J 5/40

[52] U.S. Cl. ..... 400/73; 235/439; 235/449; 400/656

[58] Field of Search ..... 400/24, 62, 105, 400/103, 104, 73, 656; 235/439, 449, 479, 486, 475

[56] References Cited

U.S. PATENT DOCUMENTS

| | | | |
|---|---|---|---|
| 3,951,251 | 4/1976 | Zaccagnino et al. | 400/24 |
| 4,196,846 | 4/1980 | Kao et al. . | |
| 4,297,735 | 10/1981 | Eppich | 360/104 |
| 4,404,649 | 9/1983 | Nunley et al. . | |
| 4,678,896 | 7/1987 | Carlson et al. . | |
| 4,731,524 | 3/1988 | Brooks . | |
| 4,944,616 | 7/1990 | Watanabe et al. | 400/105 |
| 5,040,908 | 8/1991 | Matsuya et al. | 400/62 |
| 5,053,607 | 10/1991 | Carlson et al. . | |
| 5,175,682 | 10/1992 | Higashiyama et al. . | |
| 5,274,218 | 12/1993 | Urata et al. | 235/449 |

FOREIGN PATENT DOCUMENTS 3804265 8/1989 Germany .

OTHER PUBLICATIONS

Derwent–Abstract–AN 89–249622.

*Primary Examiner*—John S. Hilten
*Attorney, Agent, or Firm*—Mitchell S. Bigel; John D. Flynn

[57] ABSTRACT

A point of sale printer includes a magnetic reader for processing transactions and payment by check at a checkout point of a retail establishment. The printer includes a magnetic or MICR reader located at a predetermined point on the printer's document travel path and a print head located at the same point on the document travel path but laterally offset from the MICR reader to allow the printer to print customer receipts and a journal as well as reading MICR information from checks and endorsing the check after it is cleared. A pressure pad is used with the magnetic read head of the MICR reader which utilizes a pressure film which flexes when a document is inserted between the magnetic read head and the pressure film to provide a spring loading force on the magnetic read head while still allowing the document to be moved smoothly past the magnetic read head. A method for processing checks using the printer utilizes bidirectional motion of the check along the document travel path to magnetize the MICR information, read the MICR information and print the endorsement on the check.

11 Claims, 5 Drawing Sheets

POINT OF SALE PRINTER WITH MAGNETIC READER

FIELD OF THE INVENTION

The present invention relates to point of sale systems in general and in particular to printers and check processors used with point of sale systems. The present invention further relates to methods for using point of sale systems.

BACKGROUND OF THE INVENTION

Face to face retail sales transactions take place at the point of sale or what is commonly referred to as the checkout line or counter. It is at this location that the customer pays for the goods purchased typically by either cash, check, charge or debit card.

To effectuate the sale, many retailers presently use electronic devices to facilitate and provide a record of transactions. Such a point of sale system may include a scanner for reading coded product price, a terminal for manual entry of transaction information and storage of currency, and a printer which may be used to produce a documentary record or journal for the business and a printed receipt for the customer. Check processing devices are also available to facilitate the transaction when a check is used for payment. Such check processing devices include a Magnetic Ink Character Recognition ("MICR") reader for reading the magnetic ink printed coded account information commonly found on the front of checks.

As part of the check out procedure, the sales price of each item purchased is entered into the point of sale terminal. Each item price and a total is printed by the point of sale printer on a customer receipt and may also be printed on a separate journal by the same point of sale printer. When paying by check, the customer then provides a check for the amount due to the cashier. The cashier inserts the check into the check processing device which reads the MICR information for further processing such as confirming sufficient fund availability or checking the information against a bad account list. A receipt is then provided from the printer to the customer.

Point of sale systems are typically located at the checkout counter where space is limited. Accordingly, a full functioned point of sale system with a reduced "footprint" is desired. Moreover, low cost reliable multifunctional parts should be utilized.

SUMMARY OF THE INVENTION

Accordingly, it is an object of the present invention to provide a point of sale printer having the capability of processing magnetically coded payment documents such as checks.

It is a further object of the present invention to provide a full function point of sale printer including check processing capability with a reduced footprint.

It is a further object of the present invention to provide a full function point of sale printer including check processing capability with reduced duplication of parts.

These and other objects are provided according to the present invention by a point of sale printer in which a magnetic read head and a print head overlap along, and are laterally offset relative to, a document travel path. This is accomplished by providing a printer including a document drive means which moves documents inserted into the printer along a document travel path. The printer also includes a magnetic reader located at a first position in the document travel path and a print head located at a second position in the document travel path. The print head (second) position overlaps the position of the magnetic reader in the document travel path and is laterally offset from the magnetic reader.

In an embodiment of a point of sale printer of the present invention the printer also includes a platen located at the same position in the document travel path as the print head. The print head is located adjacent to the platen and spaced from the platen a sufficient distance to allow documents inserted into the printer to pass between the print head and the platen along the document travel path.

In another embodiment of a point of sale printer of the present invention the print head defines a first document print station at the same position as the print head in the document travel path and further includes a second document print station at the same location in the document travel path and laterally offset from the first document print station. The first and second document print stations are both laterally offset from the magnetic reader.

The document print stations may be used respectively for printing of sales documents such as customer receipts, journal records and documents and for printing endorsement information on checks read by the magnetic reader. Where the present invention is used with a laterally extending print head such as a laser print head, the print head extends from the first document print station to the second document print station. Where moving print heads, such as a dot matrix or ink jet print head are used with the present invention, means is provided for moving the print head laterally at its position along the document travel path between the first document print station and the second document print station.

In one embodiment of a point of sale printer of the present invention including a platen as described above, the magnetic reader includes a magnetic read head. The magnetic read head is mounted in a cavity provided in the platen at the first position along the document travel path where the magnetic reader is located.

In another embodiment of a point of sale printer of the present invention, the document drive means includes a document pressure roller which has an outer contact surface which contacts a document inserted into the printer. The outer contact surface has a first region comprised of a rigid material and a second region comprised of a flexible material. The combination of rigid and flexible materials contacting the document in the document pressure roller provides both for an effective drive means to move the document and further provides for smoother movement of the document to improve reading of magnetically coded documents as they are moved past the magnetic reader.

By providing for an overlap of the print head and the magnetic reader in the document path and laterally offsetting the print head and the magnetic reader, the present invention provides a reduced footprint for a point of sale system. The present invention also provides for a reduction in parts, such as document drive parts, required to provide a full function point of sale printer including check processing capabilities.

According to another aspect of the present invention a magnetic or MICR reader is provided which includes a magnetic read head and a flexible pressure film positioned adjacent the magnetic read head. The flexible pressure film is positioned to flex when a document is inserted between the flexible pressure film and the magnetic read head.

In an embodiment of the MICR reader of the present invention, the MICR reader further includes a pressure plate with a first contact region and a second contact region displaced from the second contact region. The flexible pressure film extends between the first and second contact regions and includes a magnetic head region located between the contact regions where the flexible pressure film abuts the magnetic read head. Spring loaded connecting means is provided in one embodiment for connecting the flexible pressure film to the pressure plate so as to maintain the pressure film under tension between the first and second contact points. The pressure film acts to maintain contact between the document containing MICR coded information and the magnetic read head and smooths wrinkles out which may be present in the document. The MICR reader of the present invention may also be provided with document guide means to direct documents to be read by the reader between the magnetic read head and the flexible pressure film and a magnetic shield positioned adjacent the magnetic read head. The magnetic shield in one embodiment is connected to the pressure plate. The flexible pressure film in one embodiment is made from a polyimide.

It will be understood that the flexible pressure film of the present invention may be used with any magnetic read head and the point of sale printer of the present invention can be used without such a flexible pressure film. However, preferably they are combined to provide a high performance full function point of sale printer which includes check processing capabilities.

A method for processing checks using a full function point of sale printer with bidirectional drive capabilities such as that of the present invention is also provided. The method includes loading the document in the point of sale printer. The document is then moved in a first direction past a magnetic field to magnetize the MICR coded information then the document is moved in the opposite direction past the MICR read head to read the magnetized coded information. In one embodiment character recognition analysis is then performed on the read magnetized coded information to determine if a read error occurred. If a read error is detected the document is again moved in the first direction to magnetize the MICR coded information and in the opposite direction to read the magnetized coded information. This process may be repeated until a read without any errors is accomplished. In one embodiment, the read coded information is provided to a controller which then provides print data to the printer. In any event, after the reading operation is completed, the document is then moved in the first direction past the print head of the printer to print on the coded document. Such print information on a check will typically be endorsement information. The document is then ejected from the printer.

The bidirectional document travel method of the present invention provides for document reading and printing without any requirement for reloading the document in the printer. It further provides the capability for repeated read attempts if a read error is encountered without the necessity for reloading the document in the printer.

DETAILED DESCRIPTION OF PREFERRED EMBODIMENTS

The printer of the present invention exploits the advantages of combining the capabilities of a point of sale printer and a magnetic reader in a single device. The printer of the present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1A:
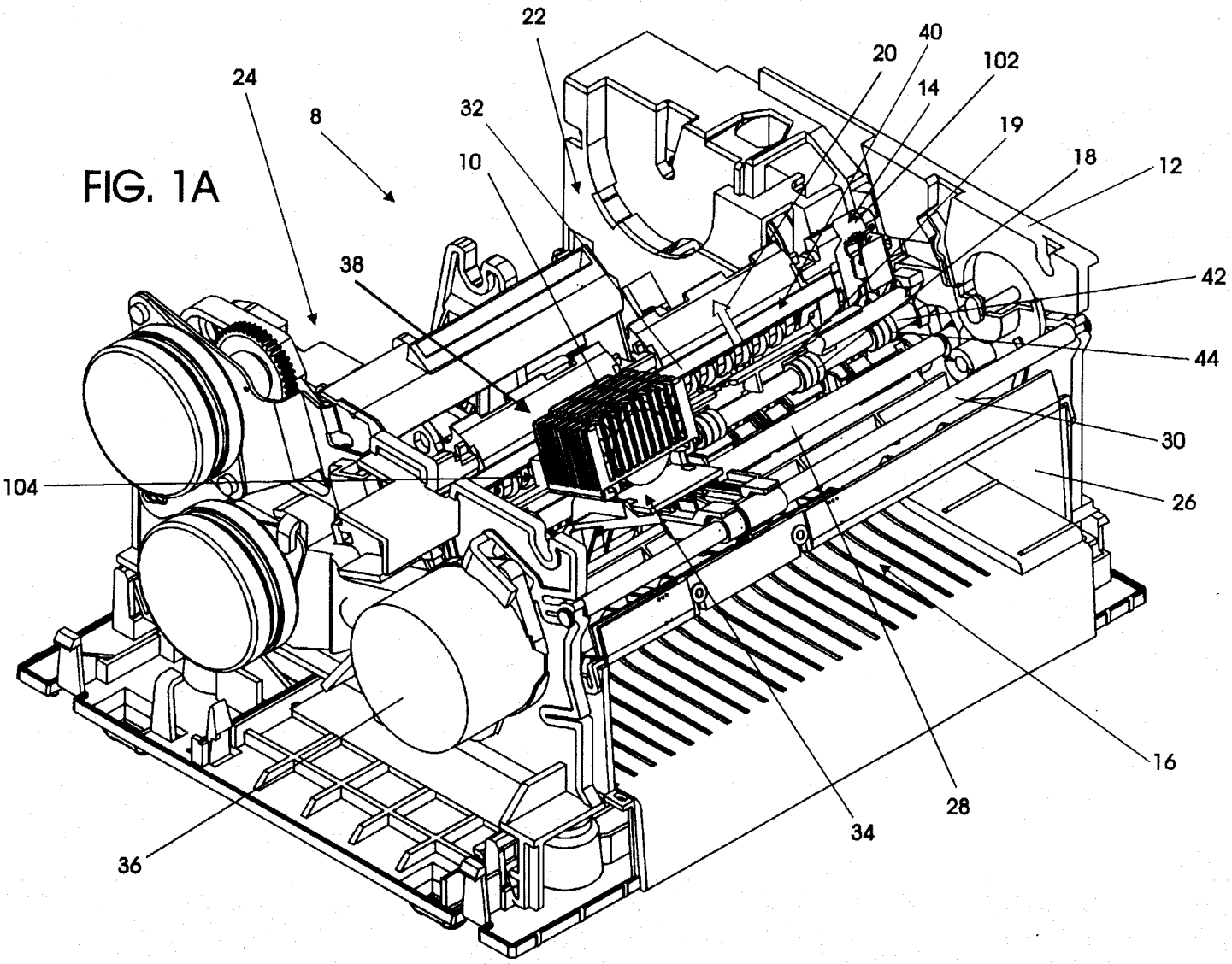
FIG. 1A is a perspective view illustrating an embodiment of the point of sale printer of the present invention.
Figure 1B:
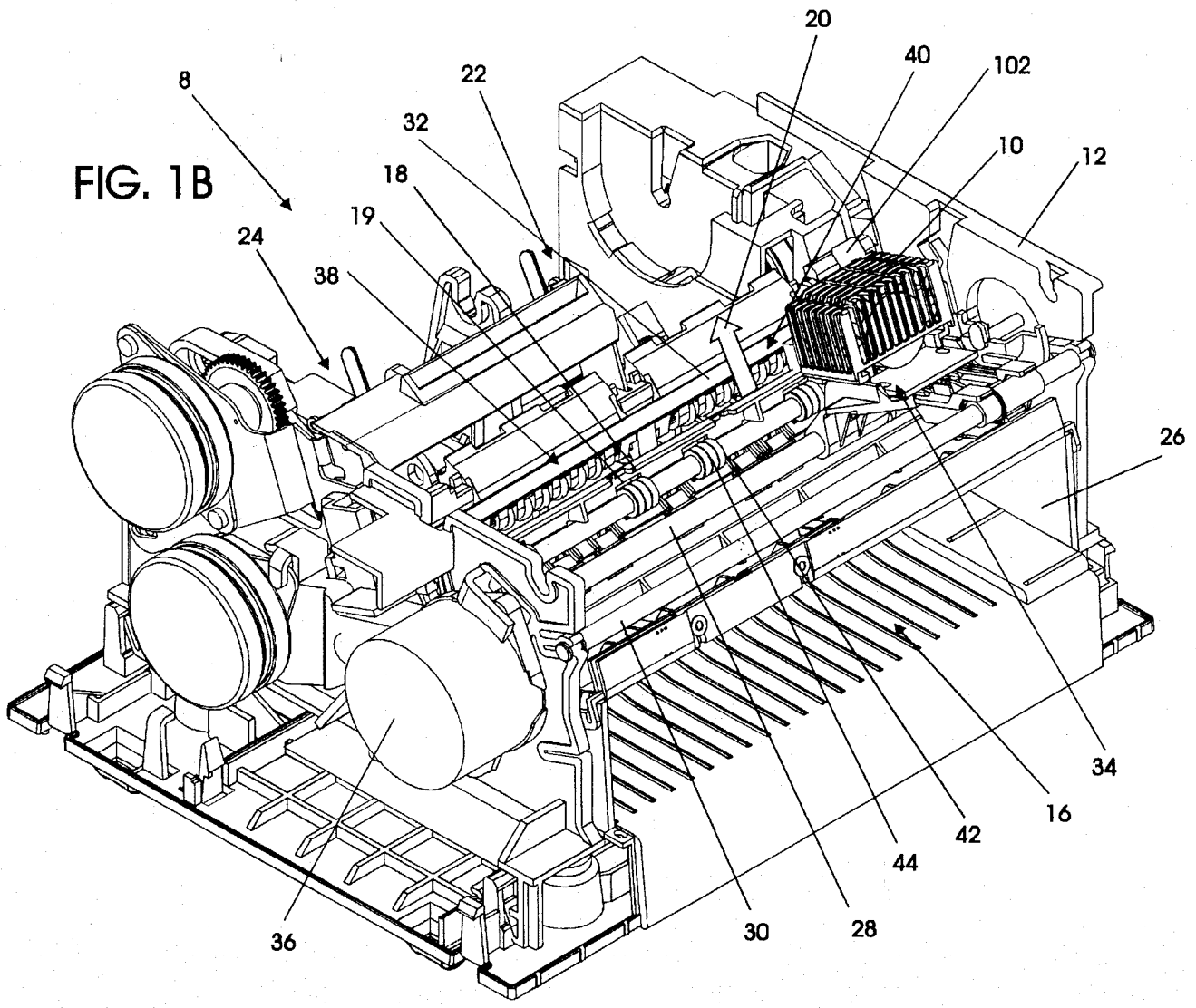
FIG. 1B is a perspective view illustrating the embodiment of the point of sale printer of the present invention illustrated in FIG. 1A with the print head moved to a position adjacent the MICR reader.

Referring now to FIGS. 1A and 1B, perspective views of the point of sale printer 8 of the present invention are shown. Such a printer is used in facilitating sales transactions at locations such as a check out counter where a customer makes payment for merchandise. As shown in FIGS. 1A and 1B, print head 10 and magnetic reader 14 are contained within housing 12. Housing 12 further includes document insertion region 16. Documents inserted into insertion region 16 are moved between pressure roller 18 and document feed roller 19 at least one of which is powered, or other document drive means, to allow documents inserted into the printer of the present invention to be moved along document travel path 20 (represented figuratively by a directional arrow) past print head 10 and magnetic reader 14. Magnetic reader 14 is mounted at a first position in document travel path 20. Print head 10 is located at a second position in travel path 20. The position of print head 10 in document travel path 20 is chosen so that print head 10 overlaps the position of magnetic reader 14 but print head 10 is laterally offset from magnetic reader 14.

As shown in FIGS. 1A and 1B, housing 12 includes additional document insertion regions 22 and 24 particularly adapted for use with paper rolls such as those used for customer receipts or journal records. Document insertion region 16 is adapted to sheet feed documents such as forms or checks and includes alignment edge 26 for positioning documents fed through document insertion region 16 laterally with respect to document travel path 20. Regardless of whether documents are inserted in region 16, 22 or 24, the documents are fed by rollers 18 and 19 along document travel path 20 past print head 10. Documents inserted in document insertion region 16 and aligned with respect to alignment edge 26 are fed by rollers 18 and 19 along document travel path 20 past magnetic reader 14.

Print head 10 is mounted on print head carrier 34 which is movably mounted on transport guide shafts 28 and 30. Print head 10 is located adjacent platen 32 and spaced from platen 32 a sufficient distance to allow documents inserted into the printer to pass between print head 10 and platen 32 along document travel path 20. It is to be understood that platen 32 may be a rigid member serving to locate the document to be printed by print head 10 and to serve as a strike surface for a dot matrix printer but it is known that platen 32 may provide for location of the document for printing in different manners for different types of print heads such as may be found in a laser printer. In a ink jet printer the platen serves to position the paper and maintain a flat paper surface so that the printed characters will be properly formed. Similarly, a laser printer typically utilizes pressure rollers as a platen. During the fusing operation the roller maintains contact between the paper and the fuser so that the toner is properly affixed to the paper.

For the dot matrix type print head illustrated in FIGS. 1A and 1B, motor 36 or other print head drive means, moves print head 10 laterally from a first document print station 38 to allow printing of customer receipts, journal records or other documents, as illustrated in FIG. 1A, to a second document print station 40 laterally displaced from first document print station 38 relative to document travel path 20 and proximate magnetic reader 14 to allow printing on checks such as endorsing of checks. FIG. 1B illustrates print head 10 positioned in second document print station 40. First document print station 38 and second document print station 40 are located at a position in document travel path 20 which overlaps the position of magnetic reader 14 but are laterally offset from magnetic reader 14. First document print station 38 and second document print station 40 may be understood to be respective portions of a single laterally extending print region over which print head 10 travels to allow the printer of the present invention to function as a standard printer for full width documents such as 8½"×11" sheets of paper for the printer illustrated in FIGS. 1A and 1B. Transport guide shafts 28 and 30 are mounted in housing 12 so as to maintain the spacing of print head 10 from platen 32 during lateral movement of print head 10. It is to be understood that the benefits of this invention may likewise be obtained using a printer not requiring a moving print head such as a laser printer in which case the print head extends from first document print station 38 to second document print station 40.

To provide for smooth transport of a document past magnetic reader 14 as is desired for reliable reading of the magnetically coded information, the outer document contact surface of document pressure roller 18 includes first region 42 comprised of a rigid material, such as stainless steel, and a second region 44 comprised of a flexible material, such as foam. As illustrated in FIGS. 1A and 1B, a plurality of such regions is provided along document pressure roller 18 laterally displaced across document travel path 20. A document inserted into the printer is then moved along travel path 20 gripped by the rigid and flexible regions of document pressure roller 18 forcing the document into contact with document feed roller 19 which is then rotated by a drive motor (not shown) to move the document up and down along document travel path 20. The outer contact surface of document feed roller 19 may be comprised of a resilient material such as rubber to prevent slippage of the document during transport. As with document pressure roller 18, document feed roller 19 may include a plurality of contact surfaces laterally displaced across document travel path 20 symmetrical with pressure roller 18. As illustrated in FIG. 1A, one of the contact surfaces of rollers 18 and 19 is positioned adjacent magnetic reader 14. This positioning assists with preventing skew during movement of a check along document travel path 20 to facilitate reading of the MICR coded information from the check.

Figure 2:
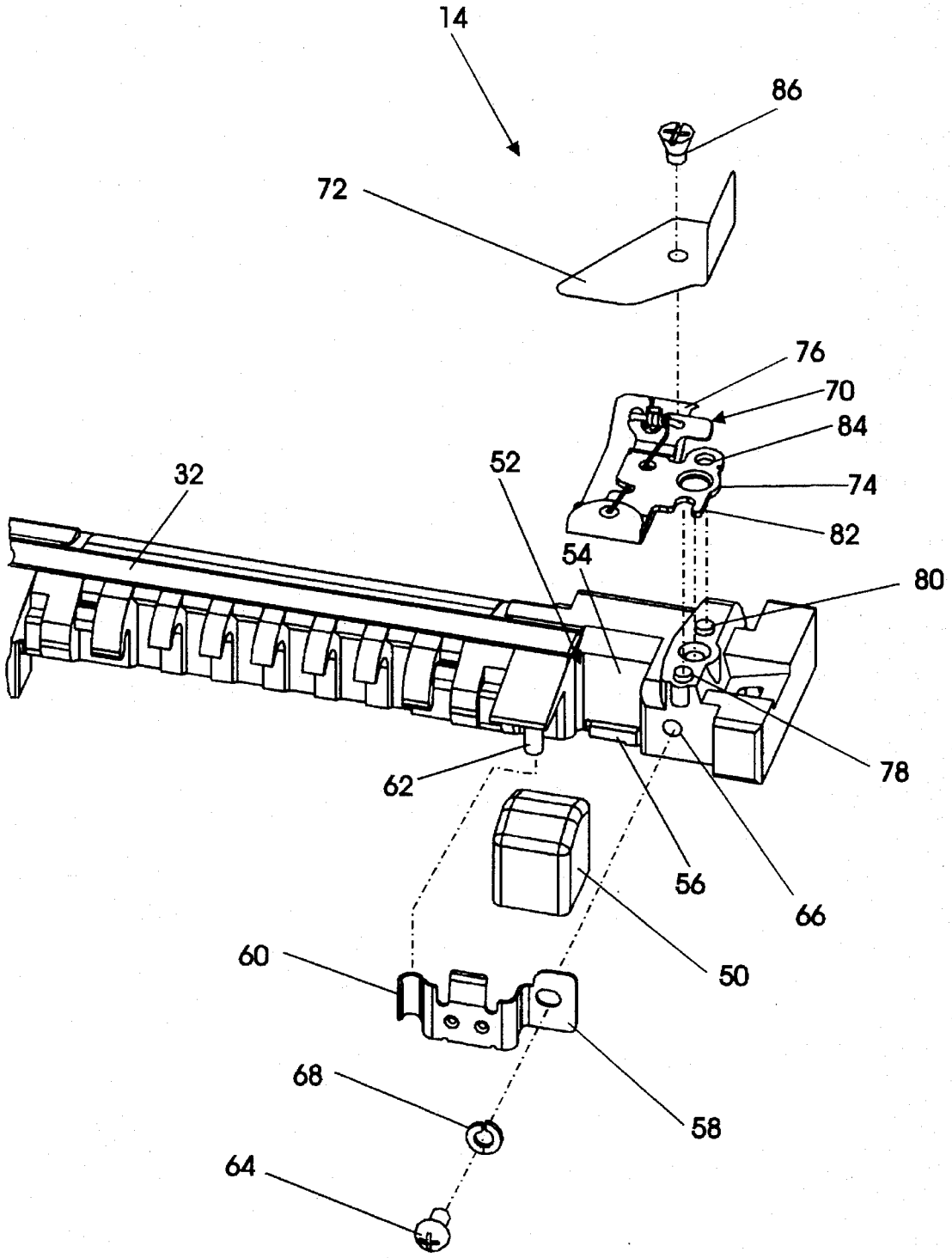
FIG. 2 is an exploded perspective view illustrating an embodiment of the pressure pad, platen and MICR read head of the present invention.

An embodiment of the magnetic reader 14 and platen 32 of the present invention in which magnetic reader 14 is connected to platen 32 is illustrated in FIG. 2. Magnetic reader 14 is illustrated in exploded perspective view to better show the various elements in the illustrated embodiment. Magnetic read head 50 is mounted in cavity 52 of platen 32. Appropriate magnetic read heads for use in reading MICR coded documents such as checks are known. It is also to be understood that the coded information on the check may utilize a scheme other than MICR and that the coded information may be read by optical means rather than magnetic means as described herein while still obtaining the benefits of the present invention of providing a point of sale printer including a print head and a reader laterally offset from each other at overlapping points on a document travel path. The location of magnetic read head 50 is determined by stops 54 and 56 respectively. Magnetic read head 50 is secured in cavity 52 by bracket 58 which is secured to platen 32 by placement of hook region 60 of bracket 58 on post 62 of platen 32 and by screw 64 inserted in threaded hole 66 of platen 32. As illustrated in FIG. 2, lockwasher 68 may be used with screw 64.

Magnetic reader 14 as illustrated in FIG. 2 further includes pressure pad 70 and magnetic shield 72. Pressure pad 70 includes pressure plate 74 and flexible pressure film 76. Pressure pad 70 is positioned on platen 32 by orientation tabs 78 and 80 which cooperate with orientation openings 82 and 84 of pressure plate 74. Pressure pad 70 and magnetic shield 72 are connected to platen 32 by screw 86. Magnetic shield 72 is connected to pressure pad 70 and platen 32 adjacent magnetic read head 50 to protect magnetic read head 50 from noise generated by motors, terminal screens or other devices which are known to generate magnetic noise which may be positioned in the area of magnetic read head 50. The placement of magnetic shield 72 adjacent magnetic read head 50 serves to minimize noise during reading of magnetically coded information such as MICR information from a check. The embodiment of the magnetic reader 14 of the present invention mounted to platen 32 as illustrated in FIG. 2 provides the benefit of controlling the positioning of pressure pad 70 adjacent magnetic read head 50 as well as the orientation of pressure pad 70 and magnetic read head 50 relative to document travel path 20.

Figure 3:
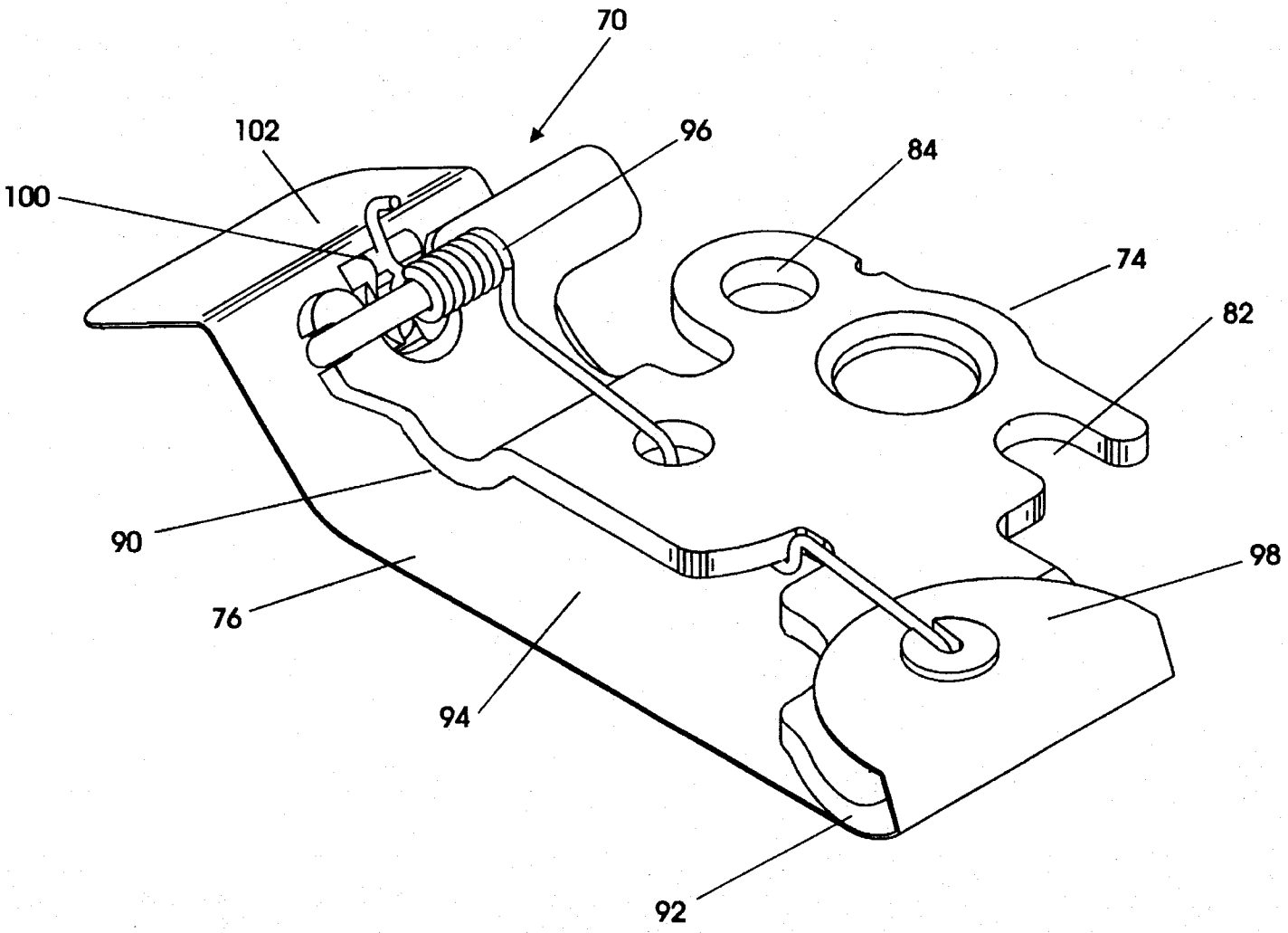
FIG. 3 is a perspective view illustrating an embodiment of the pressure pad of the present invention.

An embodiment of the pressure pad 70 of the present invention as illustrated in FIG. 2 is further illustrated in FIG. 3. Pressure plate 74 of pressure pad 70 includes laterally displaced curved contact regions 90 and 92 at first and second end portions of pressure plate 74. Pressure film 76 is connected to pressure plate 74 and extends between first contact region 90 and second contact region 92. Flexible pressure film 76 includes magnetic head contact region 94 between contact regions 90 and 92. Pressure film 76 is connected to pressure plate 74 by spring 96 or other spring loaded connecting means so as to maintain pressure film 76 under tension between first contact region 90 and second contact region 92.

As illustrated in the embodiment of FIG. 3, spring 96 connects pressure film 76 to pressure plate 74 at end 98 of pressure plate 74 where a fixed connection is made and at end 100 where the spring load is applied to pressure film 76. End 98 of pressure plate 74 further serves as a document guide means to direct documents inserted through document insertion region 16 adjacent alignment edge 26 between pressure pad 70 and magnetic read head 50 to thereby allow the magnetically coded portion of the document to pass magnetic read head 50 as the document is moved along document travel path 20 so that the magnetically coded information may be read. The curved portion of contact region 92 directs the document to travel along the face of pressure film 76 opposite pressure plate 74. Pressure pad 70 and magnetic read head 50 are positioned relative to each other so that when a document is inserted between pressure pad 70 and magnetic read head 50 pressure film 76 flexes in magnetic head region 94 so as to provide a spring loading force on magnetic read head 50 to provide for better quality of reading of the magnetically coded information from the document. Pressure film 76 may be positioned relative to magnetic read head 50 so that it does not contact magnetic read head 50 if no document is present or so that it touches magnetic read head 50 without flexing when no document is present or so that it flexes even when no document is present so long as pressure film 76 is positioned to flex when a document is inserted between pressure film 76 and magnetic read head 50.

In the embodiment illustrated in FIGS. 1A, 1B, 2 and 3, pressure plate 74 comprises a rigid material such as stainless steel. Pressure film 76 comprises a flexible material. While a variety of materials, including thin metal films may be used for pressure film 76, plastic materials may beneficially be used for this component. Preferably a polyimide such as N-trichloromethylmercapto-tetrahydro-phthalimide (trade name "Kapton") is used to provide the desired flex characteristics to the pressure pad as well as surface frictional properties to facilitate smooth movement of a document between pressure film 76 and magnetic read head 50.

It is desirable to maintain smooth movement of the coded document past read head 50 especially with the combined printer and magnetic reader of the present invention because of the document feed speeds used with point of sale printers. Such printers typically provide for document feed speeds of three inches per second and have drive mechanisms which are unreliable beyond five inches per second. In contrast, MICR readers normally operate with higher feed speeds, ranging from ten to twenty inches per second. These higher speeds provide for a greater signal to noise ratio. Therefore, the importance of smoothness of document travel and maintaining contact between the magnetically coded information and magnetic read head 50 to maximize signal and minimize jitter is greater at lower document feed speeds such as those used with the printer of the present invention.

As illustrated in FIGS. 1A and 2, pressure pad 70 also includes a ribbon guard 102 or other ribbon guard means to prevent a printer ribbon (not shown in the Figures) from passing between pressure pad 70 and magnetic read head 50 when the printer ribbon is installed in the printer of the present invention. In the embodiment shown in FIGS. 1A and 2, ribbon guard 102 is formed from a portion of pressure film 76 extending beyond end 100 of pressure plate 74 at an angle thereto. As illustrated in FIG. 1A, the angle of the ribbon guard 102 portion of pressure film 76 is selected to direct the printer ribbon to the back side of printer pad 70 and away from document travel path 20 and magnetic read head 50 when the ribbon is installed in ribbon mount 104.

Print head 50 is first used to generate customer receipts and a journal record of the items sold on paper fed either through document insertion region 16 or on paper fed from a spool in insertion regions 22 and 24. These transactions are recorded by print head 50 while it is operating in first document print station 38. Payment is then made by the customer for the costs of the transaction.

Figure 4:
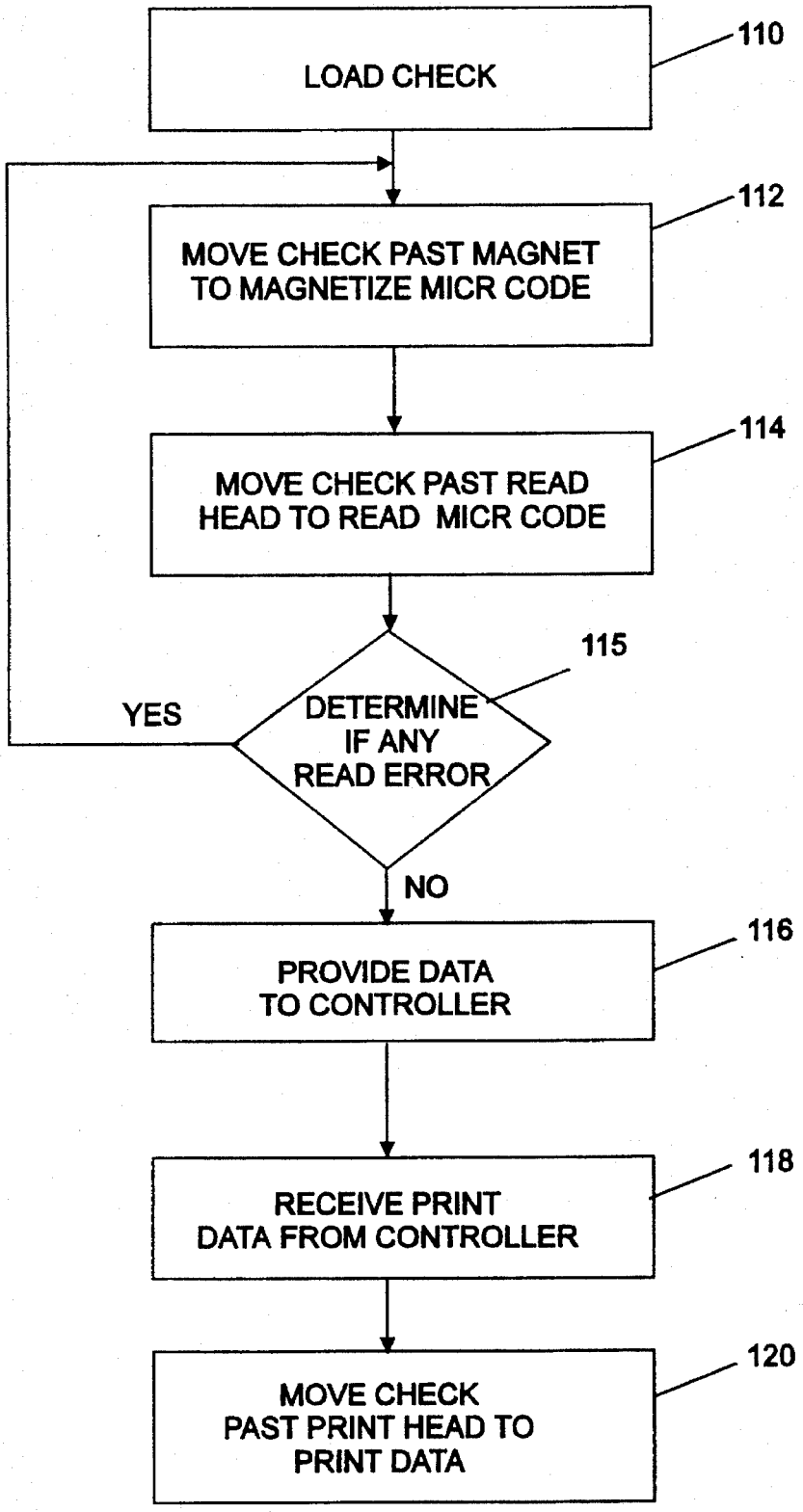
FIG. 4 is a flow chart illustrating an embodiment of the method of the present invention.

Operations for processing a check payment during a sales transaction utilizing the present invention is illustrated in FIG. 4. The check provided by the customer is inserted into the printer in insertion region 16 aligned on alignment edge 26 and placed face down at block 110. Document feed roller 19 and pressure roller 18 move the check in a first direction illustrated by arrow 20 past a permanent magnet or other magnetic field source (not shown) located on document travel path 20 to magnetize the MICR account information printed in magnetic ink on the front face of the check at block 112. Alternatively, magnetic read head 50 could itself be energized to create a magnetic field to magnetize the MICR account information during block 112. Document feed roller 19 and pressure roller 18 then move the check in the opposite direction along document travel path 20 past magnetic read head 50 to read the MICR information at block 114. Alternatively, the magnetizing and reading may both take place in the same direction so long as a magnet is placed at a point along document travel path 20 which the code printed portion of the check passes by before it passes by magnetic read head 50. The check can then be reread on the return pass prior to printing if a read error was encountered at block 115. In any event, as the check is held between rollers 18 and 19 throughout the process and is subject to bidirectional motion, as many rereads as are desired of the coded information can be attempted.

During read block 114, the check is held in contact with magnetic read head 50 by pressure film 76. The read coded information is then passed along to a terminal or other controller at block 116. Character recognition of the magnetic information may be performed in real time by a controller. If this controller is located in the printer the information read by magnetic reader 14 may be transmitted by the printer of the present invention in the form of alphanumeric characters representing information such as the account number the check is to be drawn against. Real time character recognition also provides for error detection to initiate rereads. The check is then cleared, either by remote access to the bank computer to confirm a sufficient balance and debiting the account for the amount of the transaction or by checking the account number against a data base, for example of known bad checks, maintained at the store using techniques known to those of ordinary skill in the art. After the check is cleared, print data, typically endorsement information, is received by the printer at block 118. The check is then moved in the first direction along document travel path 20 and print head 50 prints the endorsement information on the back of the check in second document print station 40 at block 120. The check is then removed from the printer. Alternatively, the printer of the present invention may also be used to print other known information on the front of the check such as payee, date and amount so that the customer need only provide a signature on the check.

While the invention has been described with specificity above with reference to the dot matrix printer and MICR reader illustrated in the drawings, it is to be understood that the present invention is likewise directed to other types of printers and to other methods presently used or which may in the future be used for magnetically encoding information on transaction documents such as checks.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A point of sale printer comprising:

document drive means, for moving documents inserted into the printer along a document travel path;

a magnetic reader positioned at a predetermined longitudinal position in said document travel path; and a print head positioned at about said predetermined longitudinal position in said document travel path, and wherein said print head is laterally offset from said magnetic reader.

2. The point of sale printer of claim 1 further comprising a platen at about said predetermined longitudinal position in said document travel path, said print head being located adjacent said platen and spaced apart therefrom a sufficient distance to allow documents inserted into the printer to pass between said print head and said platen along said document travel path.

3. The point of sale printer of claim 1 wherein said print head defines a first document print station, said point of sale printer further comprising a second document print station laterally offset from said first document print station, wherein said first document print station and said second document print station are at about said predetermined longitudinal position in said document travel path, and laterally offset from said magnetic reader.

4. The point of sale printer of claim 3 wherein said print head extends to said first document print station and said second document print station.

5. The point of sale printer of claim 3 further comprising means for laterally moving said print head at said predetermined longitudinal position in said paper path, between said first document print station and said second document print station.

6. The point of sale printer of claim 1 wherein said document drive means comprises:

a document pressure roller having an outer contact surface, said outer contact surface having a first region comprised of a rigid material and a second region comprised of a flexible material, both said first region and said second region contacting the document when a document is inserted into the printer.

7. A point of sale printer comprising:

document drive means, for moving documents inserted into the printer along a document travel path;

a magnetic reader including a magnetic read head, said magnetic reader being at a first position in said document travel path;

a print head at a second position in said document travel path wherein said second position overlaps said first position, and wherein said print head is laterally offset from said magnetic reader; and, a platen at said second position in said document travel path, said print head being located adjacent said platen and spaced apart therefrom a sufficient distance to allow documents inserted into the printer to pass between said print head and said platen along said document travel path; and wherein said platen includes a cavity therein at said first position, and wherein said magnetic read head is mounted in said cavity.

8. The point of sale printer of claim 7 wherein said magnetic reader includes a flexible pressure film positioned adjacent said magnetic read head so as to flex when a document is inserted between said flexible pressure film and said magnetic read head and so as to allow documents inserted into the printer to pass between said magnetic read head and said flexible pressure film along said document travel path.

9. A point of sale printer comprising:

document drive means, for moving documents inserted into the printer along a document travel a magnetic reader including a magnetic read head, said magnetic reader being at a first position in said document travel path;

a print head at a second position in said document travel path wherein said second position overlaps said first position, and wherein said print head is laterally offset from said magnetic reader; and a flexible pressure film positioned adjacent said magnetic read head so as to flex when a document is inserted between said flexible pressure film and said magnetic read head and so as to allow documents inserted into the printer to pass between said magnetic read head and said flexible pressure film along said document travel path.

10. The point of sale printer of claim 9 wherein said flexible pressure film comprises a polyimide.

11. The point of sale printer of claim 9 further comprising a pressure plate having a first contact region and a second contact region displaced from said first contact region, said pressure film extending between said first contact region and said second contact region, said pressure film having a magnetic head region located between said first contact region and said second contact region wherein said pressure film is positioned adjacent said magnetic read head so as to provide a spring loading force on said magnetic read head when a document is inserted between said pressure film and said magnetic read head.

* * * * *